US006735808B2

(12) United States Patent
Chen

(10) Patent No.: US 6,735,808 B2
(45) Date of Patent: May 18, 2004

(54) BATH BRUSH

(76) Inventor: Kuo-Chin Chen, 2F-1, No. 18, Alley 47, Lane 208, Jui An Street, Ta An District, Taipei (TW)

( * ) Notice: Subject to any disclaimer, the term of this patent is extended or adjusted under 35 U.S.C. 154(b) by 93 days.

(21) Appl. No.: 09/945,647

(22) Filed: Sep. 5, 2001

(65) Prior Publication Data

US 2003/0041401 A1 Mar. 6, 2003

(51) Int. Cl.[7] ..... A47K 7/02
(52) U.S. Cl. ..... 15/110; 601/137; 601/138
(58) Field of Search ..... 15/110, 22.1; 601/137, 601/138, 17, 109, 111, 114, 135; 132/120

(56) References Cited

U.S. PATENT DOCUMENTS 5,211,494 A * 5/1993 Baijnath ..... 401/28
6,098,233 A * 8/2000 Chen ..... 15/110

* cited by examiner

*Primary Examiner*—Robert J. Warden, Sr.
*Assistant Examiner*—S Balsis

(57) ABSTRACT

A bath brush includes a main body, a massaging member, and a bristle holder connected to a top of the massaging member. The bristle holder is provided with a plurality of insertion holes for implanting tufted bristles therein and a plurality of through holes for massaging projections integrally formed on the massaging member to upward extend therethrough and expose from the bristle holder. An assembly of the massaging member and the bristle holder is connected to one side of the main body to form a bath brush having massaging projections that do not easily separate therefrom to ensure the brush and massage functions of the bath brush. And, the massaging member may be easily assembled to the bristle holder to enable reduced manufacturing cost of the bath brush.

6 Claims, 7 Drawing Sheets

BATH BRUSH

BACKGROUND OF THE INVENTION

The present invention relates to a bath brush, and more particularly to a bath brush that includes a massaging member having integrally formed massaging projections to enable quick connection of the massaging member to a bristle holder of the bath brush and reduced manufacturing cost thereof. The integrally formed massaging projections do not easily separate from the bath brush to ensure the brush and massage functions thereof.

Most commercially available bath brushes have a substantially rectangular configuration and include a main body and a plurality of tufted bristles with adequate softness densely implanted on a surface of the main body. Such conventional bath brushes are only adapted to brush and clean a user's skin without other functions and do not provide comfortable feeling when they touch the user's skin.

U.S. Pat. No. 6,098,233 granted to the same inventor of the present invention discloses a bath brush as shown in FIGS. 1 and 2. The bath brush of U.S. Pat. No. 6,098,233 mainly includes a main body 1 and a bristle holder 3. The main body 1 is provided at a top surface with a plurality of round recesses 11, each of which has a massaging bar 2 inserted and bonded therein. The massaging bar 2 has a substantially semispherical top end.

The main body 1 is provided at a bottom side with a belt 4, two ends of which is fixed to two lateral sides of the main body 1 by means of nails 41, so that a space is left between the belt 4 and the bottom side of the main body 1 for a user's hand to extend therethrough for holding the bath brush. The bristle holder 3 is connected to a top surface of the main body 1 by means of nails 33 or a bonding agent. A plurality of bristles 31 are implanted on a top surface of the bristle holder 3. The bristle holder 3 is also provided with through holes 31 for the massaging bars 2 to upward extend therethrough.

To produce the above-described bath brush, the massaging bars 2 are inserted one by one into the recesses 11 preformed on the main body 1. This production manner is time-consuming and requires increased manufacturing cost. Moreover, the massaging bars 2 tend to loosen and separate from the main body 1 when the bath brush has been used to brush the user's skin to and fro over a long time.

It is therefore tried by the inventor to develop an improved bath brush having a massaging member with integrally formed massaging projections, so that the bath brush could be quickly assembled at reduced time and labor costs and the massaging member thereof is more effective and durable for use.

SUMMARY OF THE INVENTION

A primary object of the present invention is to provide a bath brush having a plurality of massaging projections that do not easily loosen and separate from the brush to ensure the clean and massage functions of the bath brush.

Another object of the present invention is to provide a bath brush having an integrally formed massaging member that could be quickly assembled to a bristle holder and a main body of the bath brush to reduce labor and time costs and therefore increase the competitive ability of the bath brush in the market.

To achieve the above and other objects, the bath brush of the present invention mainly includes at least a main body, a massaging member, and a bristle holder connected to a top of the massaging member. The bristle holder is provided with a plurality of insertion holes for implanting tufted bristles therein and a plurality of through holes for massaging projections integrally formed on the massaging member to upward extend therethrough and expose from the bristle holder. An assembly of the massaging member and the bristle holder is connected to one side of the main body to form a bath brush having massaging projections that do not easily separate from the bath brush to ensure the brush and massage functions of the bath brush. And, the bath brush may be easily assembled from the main body, the massaging member, and the bristle holder to enable reduced manufacturing cost and increased competitive ability of the bath brush.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The structure and the technical means adopted by the present invention to achieve the above and other objects can best be understood by referring to the following detailed deserption of the preferred embodiments and the accompanying drawings, which are given by way of illustration only, and thus are not limitative of the present invention, and wherein.

DETAILED DESCRIPTION OF THE PREFERRED EMBODIMENTS

Figure 1:
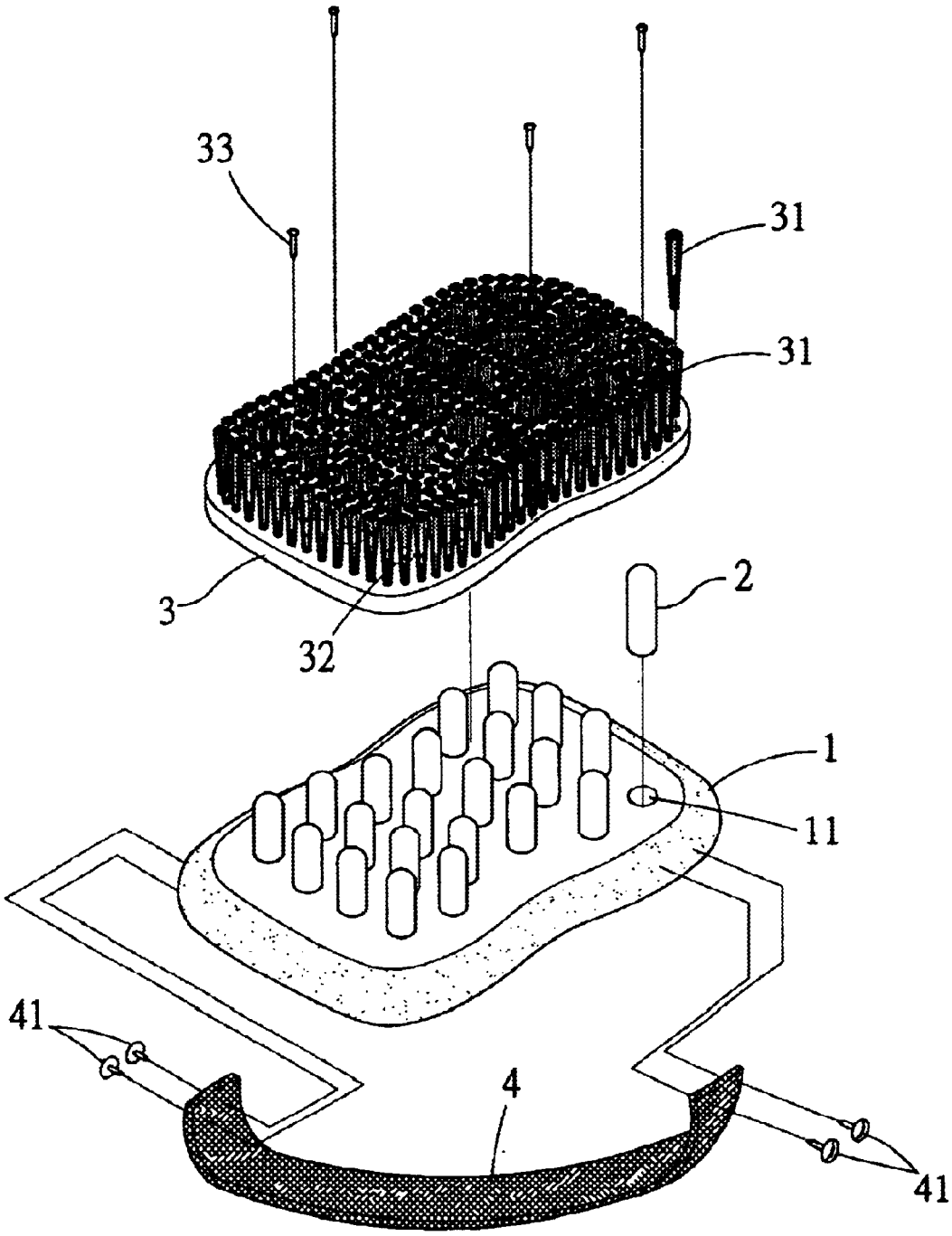
(PRIOR ART) Fig.1
FIG. 1 is an exploded perspective view of a conventional bath brush.
Figure 2:
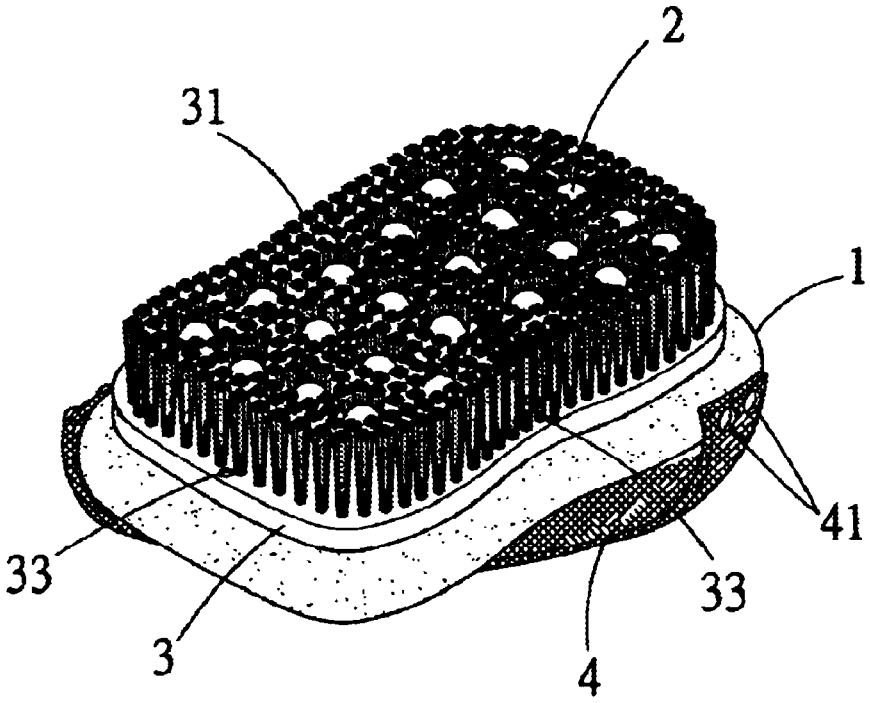
(PRIOR ART) Fig.2
FIG. 2 is an assembled perspective view of the bath brush of FIG. 1.
Figure 3:
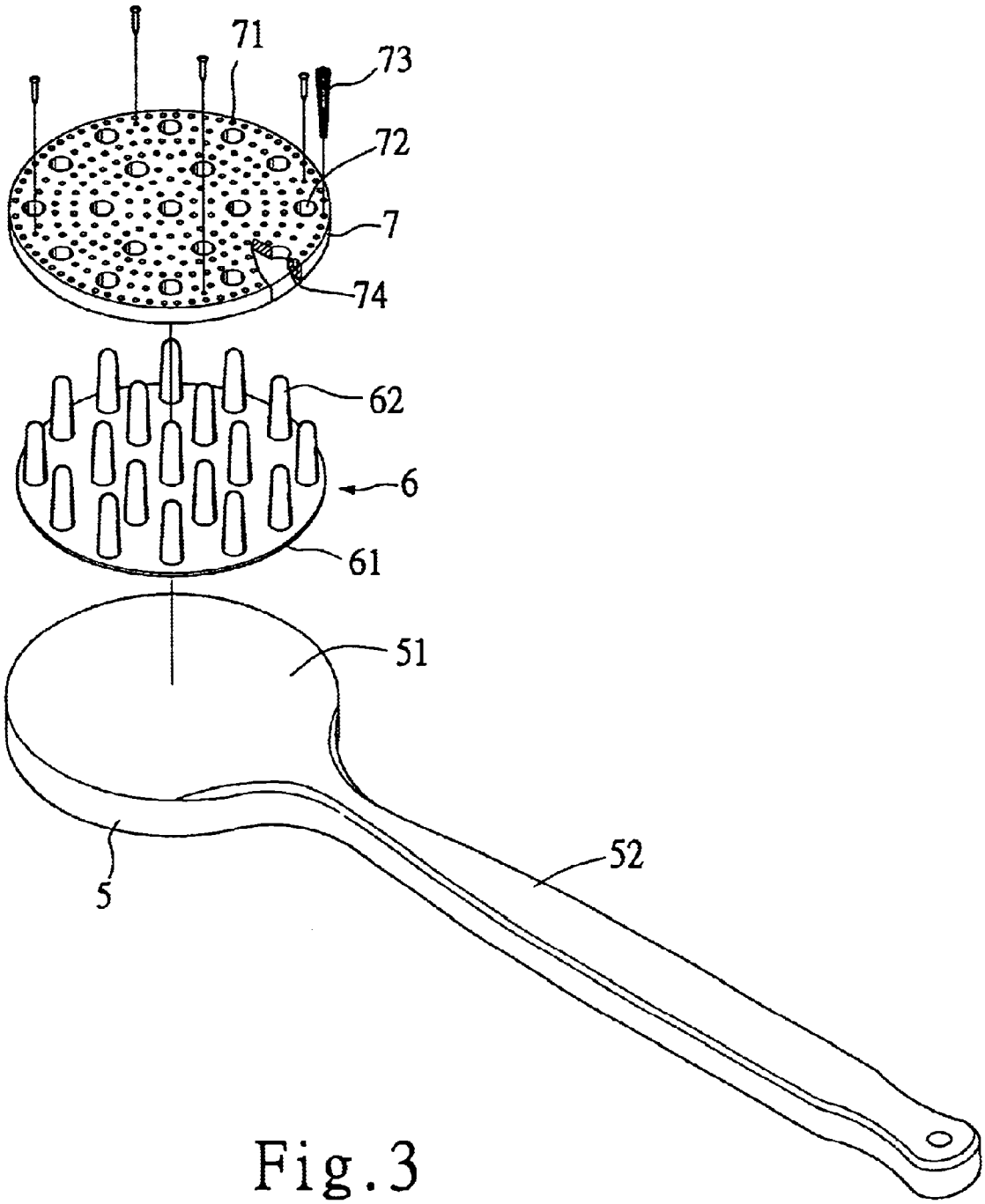
FIG. 3 is an exploded perspective view of a bath brush according to the present invention.
Figure 4:
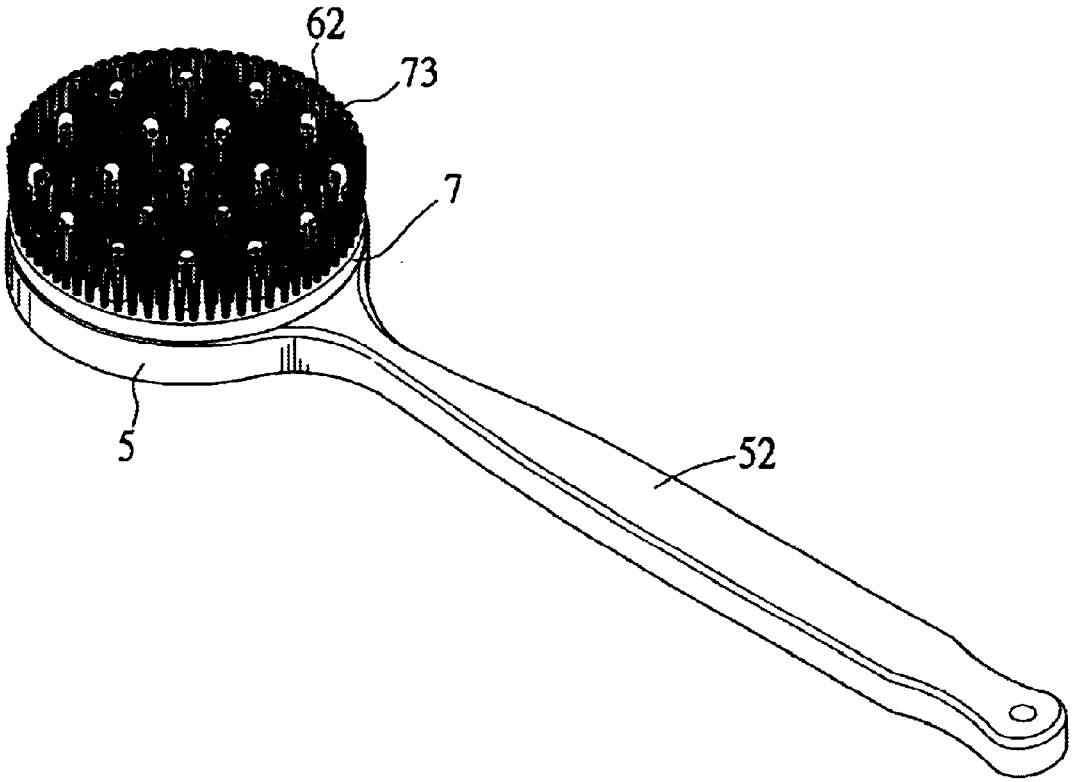
FIG. 4 is an assembled perspective view of the bath brush of FIG. 3.

Please refer to FIGS. 3 and 4 that are exploded and assembled perspective views, respectively, of a bath brush according to the present invention. As shown, the bath brush mainly includes a main body 5, a massaging member 6, and a bristle holder 7.

The main body 5 includes a head portion 51 and a long handle portion 52 extended from one side of the head portion 51.

The massaging member 6 is an integrally formed member having a flexible bed 61 and a plurality of cylindrical massaging projections 62 upward extended from a top surface of the flexible bed 61.

The bristle holder 7 is preformed at a top surface with a plurality of round insertion holes 71, into each of which tufted bristles 73 are implanted, and a plurality of through holes 72 distributed among the insertion holes 71 corresponding to the massaging projections 62 on the massaging member 6 for the massaging projections 62 to separately extend therethrough and expose from the bristle holder 7. Moreover, the bristle holder 7 is provided along a bottom periphery with a circle of setting groove 74 for receiving an outer periphery of the flexible bed 61 of the massaging member 6 therein.

With the arrangements, the bath brush may be quickly assembled for use simply by directly upward extending the massaging projections 62 of the massaging member 6 through the through holes 72 on the bristle holder 7 and engaging the outer periphery of the flexible bed 61 into the setting groove 74, and then using fastening means, such as nails, to further connect an assembly of the bristle holder 7 and the massaging member 6 to one side of the head portion 51 of the main body 5 of the bath brush.

Figure 5:
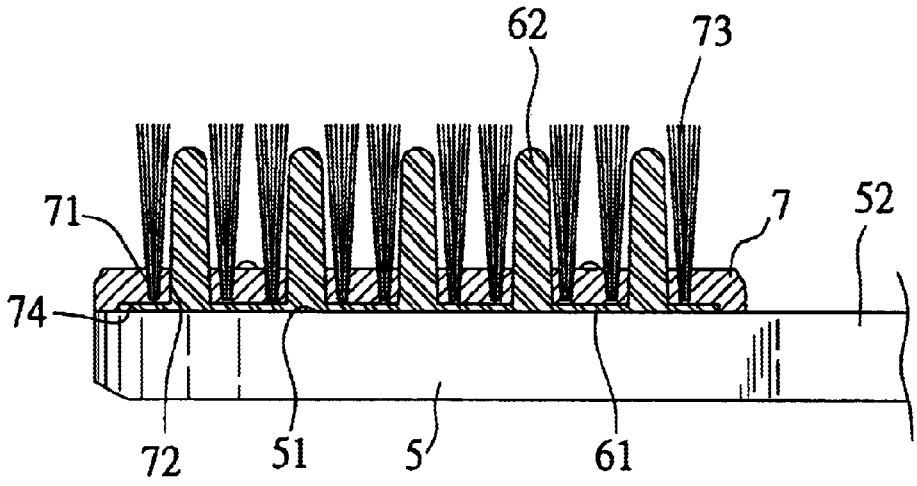
FIG. 5 is a partially sectioned side view of a bath brush according to a preferred embodiment of the present invention.
Figure 6:
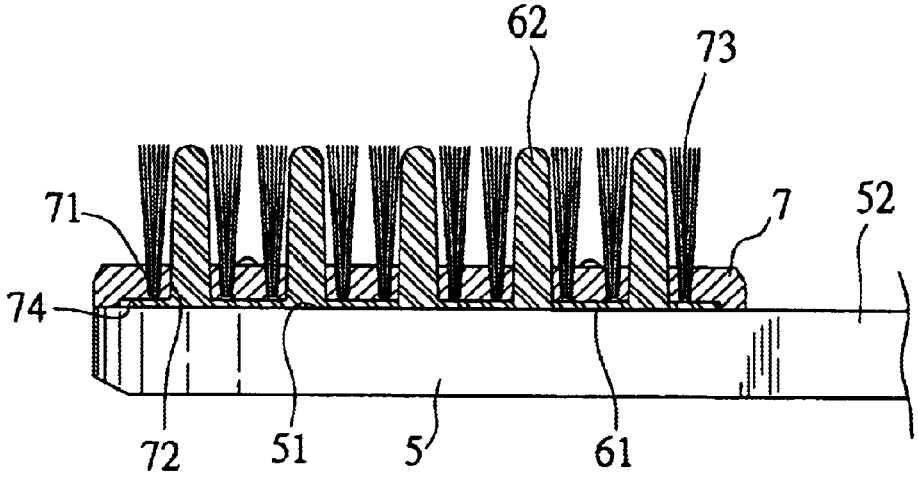
FIG. 6 is a partially sectioned side view of a bath brush according to another embodiment of the present invention.
Figure 7:
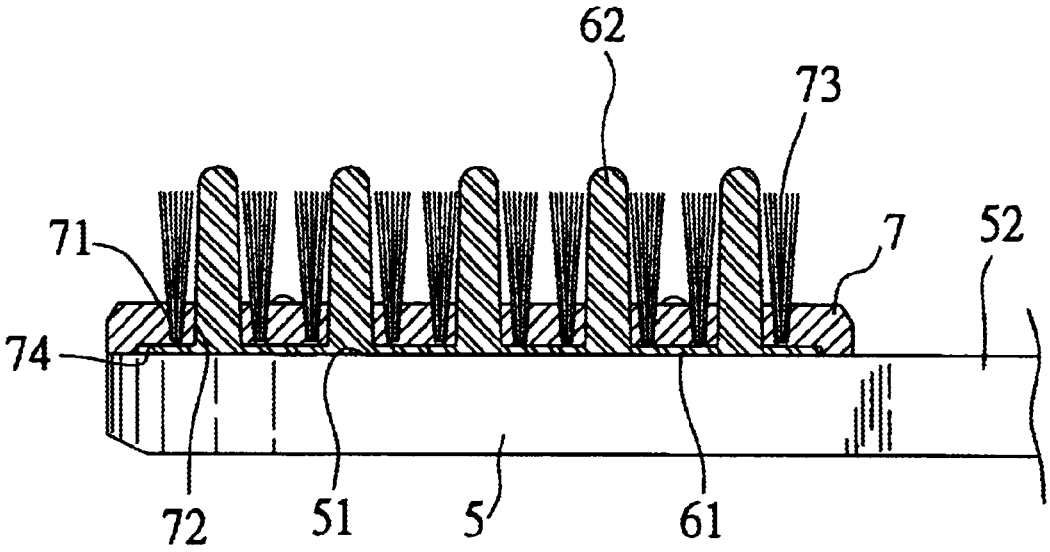
FIG. 7 is a partially sectioned side view of a bath brush according to a further embodiment of the present invention.
Figure 8:
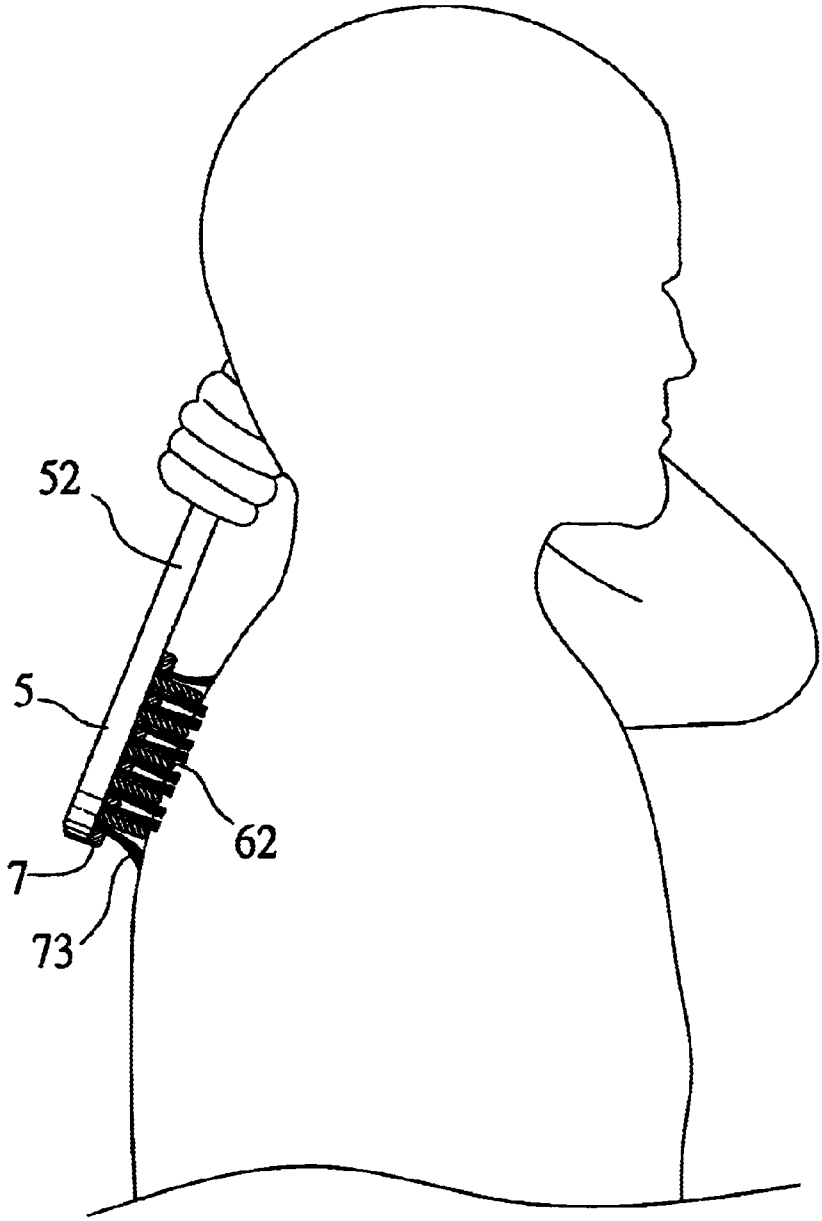
FIG. 8 is a schematic view showing the use of the bath brush of the present invention.

FIG. 5 is a partially sectioned side view of a bath brush according to a preferred embodiment of the present invention. In this preferred embodiment, the massaging projections 62 have tops slightly lower than that of the tufted bristles 73. FIG. 6 is a partially sectioned side view of a bath brush according to another embodiment of the present invention, wherein the massaging projections 62 have tops flush with that of the tufted bristles 73; and FIG. 7 is a partially sectioned side view of a bath brush according to a further embodiment of the present invention, wherein the massaging projections 62 have tops slightly higher than that of the tufted bristles 73.

To use the bath brush of the present invention to brush and massage a user's skin, the user needs only to grip at the long handle portion 52 of the main body 5 and apply a force to move the head portion 51 around areas to be cleaned. At this point, the bristles 73 would be slightly bent, allowing the tops of the massaging projections 62 to contact with the skin to massage the same. The bath brush of the present invention is therefore more comfortable for use.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bath brush, comprising a main body, a massaging member having a bed with a plurality of integrally formed and upwardly extended massaging projections, the bed and massaging projections being a one-piece element, the bath brush further comprising a bristle holder; said bristle holder being connected to said massaging member to form an assembly for fixing onto a top surface of said main body; and said bristle holder being performed at a top surface with a plurality of insertion holes, into each of which tufted bristles are implanted, and a plurality of through holes distributed among said insertion holes corresponding to said massaging projections on said massaging member for said massaging projections to separately extend therethrough and expose from said bristle holder without easily separating from said bath brush, the bed of the massaging member being sandwiches between the bristle holder and said main body.

2. The bath brush as claimed in claim 1, wherein said main body includes a long handle extended from one side of said main body for easy grip of said bath brush by a user.

3. The bath brush as claimed in claim 1, wherein said massaging projections of said massaging member have tops slightly lower than that of said tufted bristles after said massaging member has been connected to said bristle holder.

4. The bath brush as claimed in claim 1, wherein said massaging projections of said massaging member have tops flush with that of said tufted bristles after said massaging member has been connected to said bristle holder.

5. The bath brush as claimed in claim 1, wherein said massaging projections of said massaging member have tops slightly higher than that of said tufted bristles after said massaging member has been connected to said bristle holder.

6. The bath brush as claimed in claim 1, wherein said bristle holder is provided along a bottom periphery with a circle of setting groove, and said massaging member being connected to said bristle holder by engaging an outer periphery into said setting groove of said bristle holder.

* * * * *

UNITED STATES PATENT AND TRADEMARK OFFICE

CERTIFICATE OF CORRECTION

PATENT NO. : 6,735,808 B2
APPLICATION NO. : 09/945647
DATED : May 18, 2004
INVENTOR(S) : Kuo-Ching Chien It is certified that error appears in the above-identified patent and that said Letters Patent is hereby corrected as shown below:

Title page,
Item (76), Inventors, change "Kuo-Chin Chen" to --Kuo-Ching Chien--.

Signed and Sealed this

Third Day of April, 2007

JON W. DUDAS
*Director of the United States Patent and Trademark Office*